United States Patent [19]

Bunnell et al.

[11] Patent Number: 4,580,926

[45] Date of Patent: Apr. 8, 1986

[54] FOUNDATION LEVEL AND ORIENTATION TOOL

[75] Inventors: Robert L. Bunnell, Houston; Henry W. Miller, Dallas; Joseph R. Padilla, Houston, all of Tex.

[73] Assignee: Mobil Oil Corporation, New York, N.Y.

[21] Appl. No.: 536,804

[22] Filed: Sep. 28, 1983

[51] Int. Cl.[4] ..... E02D 27/52; E02D 35/00

[52] U.S. Cl. ..... 405/195; 405/224

[58] Field of Search ..... 405/195, 224, 225, 226, 405/227, 185, 204, 229; 33/365, 377

[56] References Cited

U.S. PATENT DOCUMENTS 4,405,261 9/1983 Lawson ..... 405/227

4,408,932 10/1983 Cowan ..... 405/227

FOREIGN PATENT DOCUMENTS 59227 5/1980 Japan ..... 405/225

*Primary Examiner*—David H. Corbin

*Attorney, Agent, or Firm*—A. J. McKillop; Michael G. Gilman; Frank J. Kowalski

[57] ABSTRACT

A tool for undersea oil recovery operations having a framework to carry instruments to the sea bottom to determine the angle of inclination of a ring girder secured to a monopile driven into the sea bottom. The same tool, with minor modifications, is used to transport a wedge-shaped leveling wafer to the bottom after the wafer has been fabricated to correct the previously determined inclinations.

20 Claims, 10 Drawing Figures

FOUNDATION LEVEL AND ORIENTATION TOOL

SUMMARY OF THE INVENTION

The present invention relates to undersea oil recovery operations and, in particular, a tool for determining the angle of inclination and global bearing of a ring girder attached to a monopile which has been driven into the sea bottom. It is essential that the platform to be constructed upon the ring girder be very nearly level. At the same time, it is nearly impossible to drive a monopile into the sea bottom so that it is perfectly vertical. Thus, when a ring girder is perpendicularly secured to such a monopile, it will be inclined and it is necessary to determine the degree of inclination so that a corrective wedge-shaped wafer can be assembled on the surface and placed over the ring girder to thus achieve a level surface for a template upon which wells will be drilled and equipment will be placed. The present invention is directed to a tool used for two different purposes: first, to carry instrumentation to measure the angle of inclination of such a ring girder and, secondly, to transport the leveling wafer to the site of the monopile-ring girder and properly position that wafer on the girder.

BACKGROUND OF THE INVENTION

The present invention pertains to subsea production platforms which connect a plurality of hydrocarbon producing wells with flow lines to transport hydrocarbons to storage facilities and, more particularly, to a tool used in construction of a level platform on a monopile which is deep underwater, perhaps up to 2500 feet deep.

It is known in the art to drill a plurality of wells in the same area and to bring the product from those wells to one central point for transportion to the surface. This central point is usually a subsea structure which needs to have a nearly level platform for a template for supporting necessary associated equipment. In the prior art, a plurality of concrete pilings, leveled by adjusting the heights of the respective pilings, was used. A platform would then be secured to these pilings. However, a new system is being developed by the present assignee so as to use a single piling of quite large size, that is, of about 6 feet in diameter and a length of several hundred feet driven into the ocean floor to support a platform. A steel ring girder is attached to the monopile and it is then necessary to obtain a level surface on that ring girder in order to support a template upon which the equipment will be placed. This ring girder is normally about 25 feet in diameter and needs to be level within about 3 inches across its 25 foot diameter. As the depth increases down to more than 2000 feet, leveling of the template becomes more and more of a problem, particularly if the monopile is not nearly vertical.

Further details as to the monopile and use of a leveling wafer in connection with it may be found in assignee's copending patent applications, Ser. No. 432,880 filed Oct. 5, 1982, entitled "Method For Leveling A Subsurface Template" and Application Ser. No. 432,883 filed Oct. 5, 1982, entitled "Hydraulically Actuated Slip-Type Connector" and in Application Ser. No. 343,634, filed Sept. 28, 1982, entitled "Subsea Well Completion System", all of which are now incorporated by reference herein in their entirety.

The foregoing figures are given by way of illustration and not limitation, in order to illustrate a particular preferred embodiment of the present invention.

DESCRIPTION OF THE PREFERRED EMBODIMENT

Figure 1:
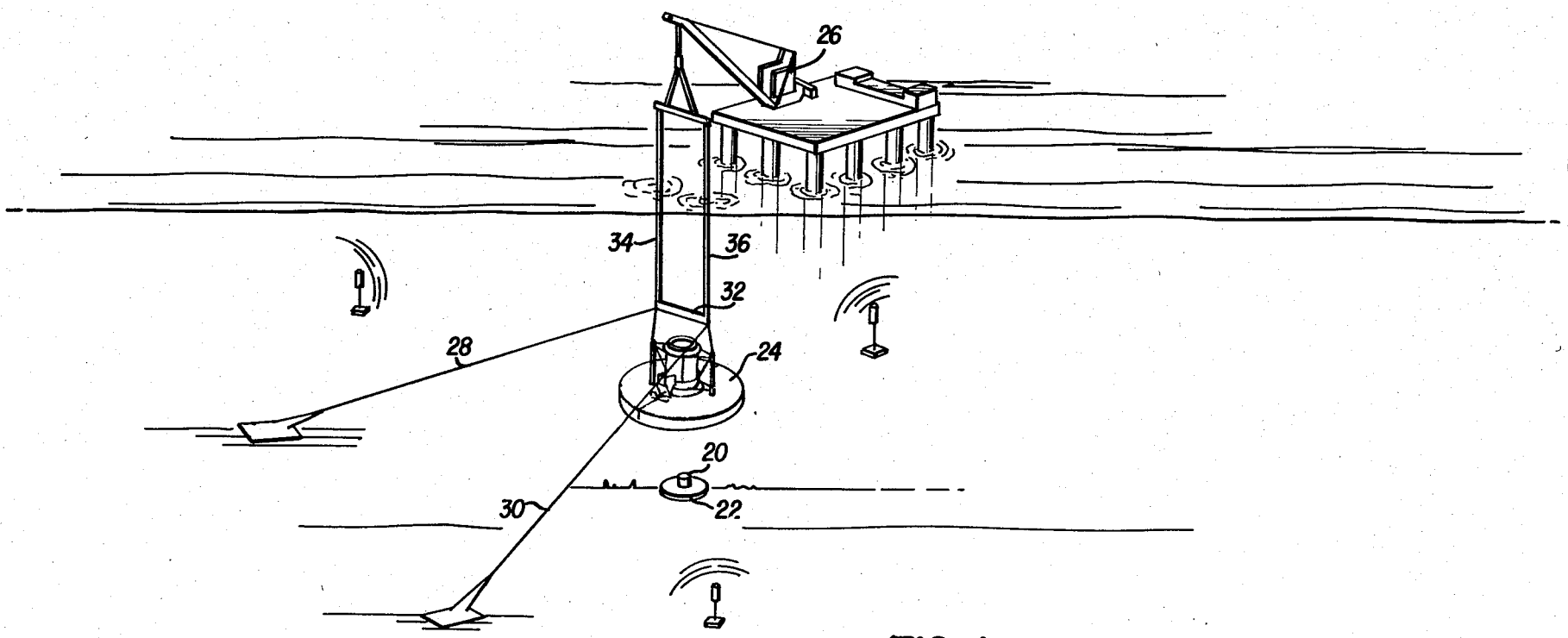
FIG. 1 is a perspective overall view showing a tool of the present invention being lowered into the water from a drilling platform.

FIG. 1 illustrates a monopile 20 driven into the sea bottom and supporting a platform 22, upon which is being lowered a foundation level and orientation tool 24, according to the present invention. The tool 24 is shown in its second use, to be described later in detail, to transport a leveling wafer 64 to the platform 22.

The tool 24 is being lowered from a drilling platform by crane 26, while its rotation and lateral movement are controlled by cables 28 and 30 and supported overhead by a crossbeam 32 and cables 34 and 36.

Figure 2:
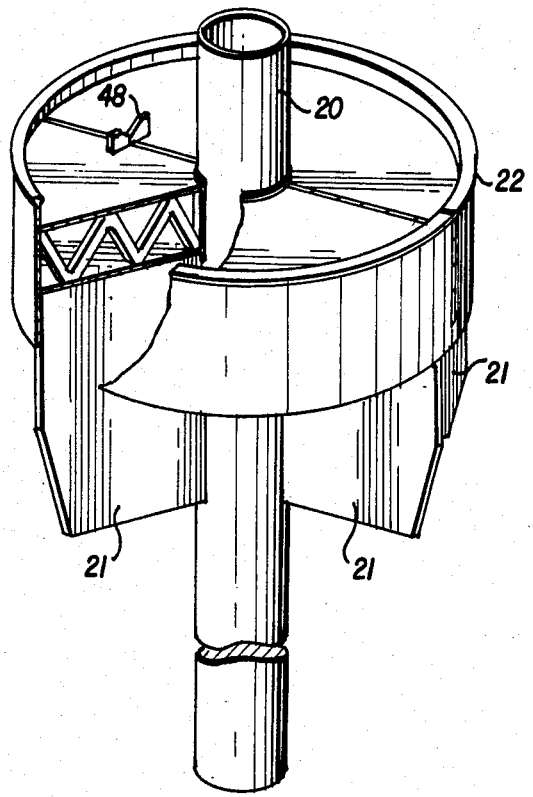
FIG. 2 is a perspective view of a monopile support and ring girder.

FIG. 2 illustrates the monopile 20, with attached steel ring girder 22 firmly secured to the monopile, and generally perpendicular to its axis. The ring girder is at an angle of inclination complimentary to that of the monopile, since the surface of the ring girder is secured, preferably by welding, generally perpendicular to the axis of the monopile. The ring girder has a plurality of downwardly extending fins 21 thereon.

It is then necessary to accurately survey the installed pile so as to ascertain the degree of correction which is needed in order to obtain a level platform above ring girder 22. To do so, three pieces of information are necessary: (1) the amount that the ring girder departs from the horizontal, (2) the azimuth direction of this departure, and (3) the direction of the orientation plate from the pile center line. The tool of the present invention is designed to carry equipment to ascertain these measurements and, after the measurements have been obtained and a suitable wedge-shaped leveling wafer is assembled, the tool is used as a carrying tool to guide that leveling wafer to be installed over the pile and above the ring girder.

The tool must land on the pile and conform to its attitude before the above-mentioned measurements can be made. Of course, it is the ring girder rather than the pile itself whose attitude must be determined. To guide the present tool over the piling to thus engage the ring girder, it preferably has a circular hollow central portion which will fit over the monopile and be of slightly larger diameter than the monopile.

Figure 4:
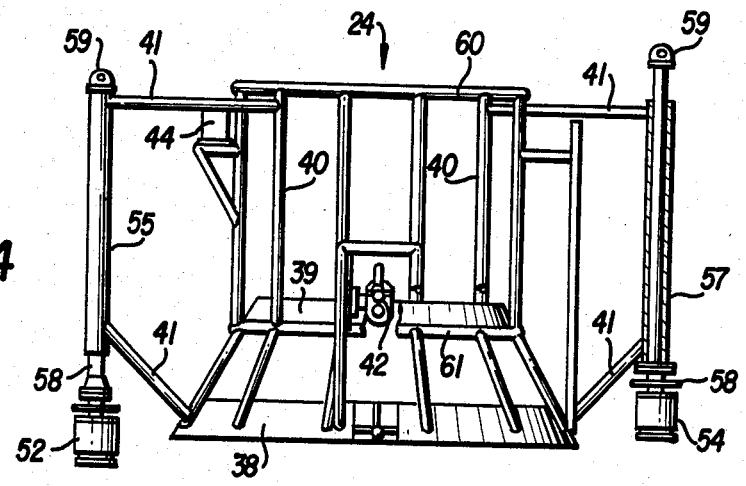
FIG. 4 is a side elevation of the tool of the present invention.

Referring now to FIG. 4, a rolled and welded steel lower cone 38 is firmly secured to the frame member of the tool 24 through angled braces which are welded to lower circular brace 61, and is used on the base of the tool to aid in landing and centering the tool over the pile. The bottom of the cone 38 is preferably the reference plane for measuring the ring girder attitude and is the means for contacting the upper surface of the ring girder in a preferred embodiment, but of course other contacting means may also be placed in addition to or in lieu of that contact, such as on the radially outer portions of the tool. The remaining structure of the tool is used to support instruments, to center the tool on the pile and to locate the orientation plate. This remaining structure preferably comprises a plurality of interconnected braces 40 which form a structure of high inherent strength.

Three-inch diameter nominal structural tubing is used to construct the braces 40 of the frame. This frame supports and protects instrument packages and ties in the lift points to the tool. The cone 38 is removable and is installed to center the tool on the pile and ensure that the reading of the orientation plate on the ring girder is accurate. To align the tool with this plate, an orientation pin is provided with a TV camera 42 to monitor the landing operation.

Figure 5:
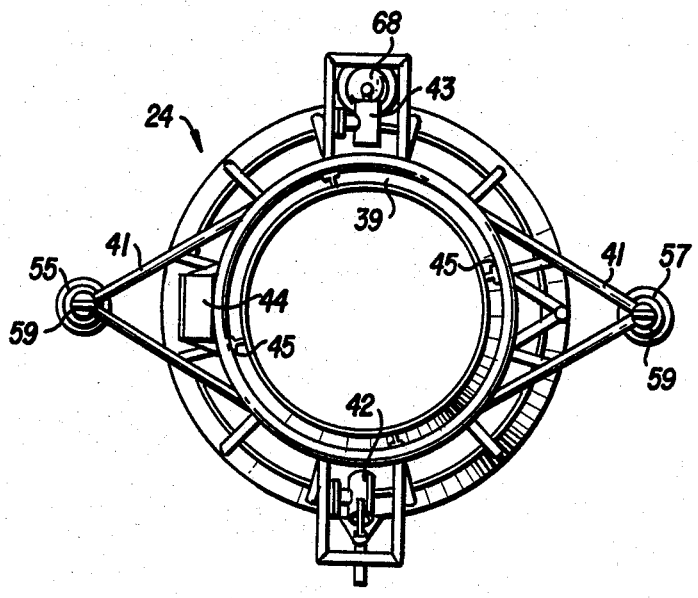
FIG. 5 is a top view thereof.
Figure 6:
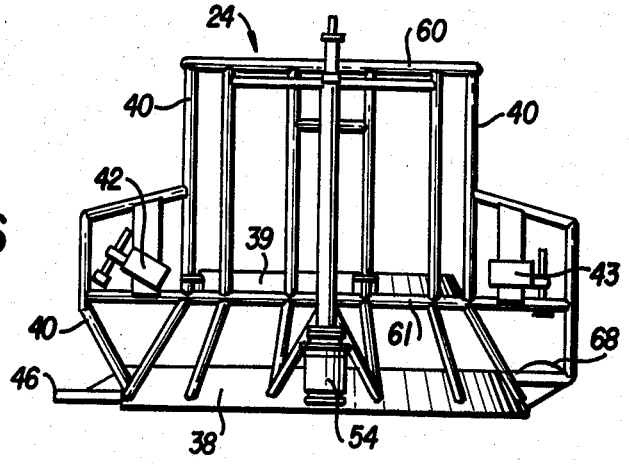
FIG. 6 is a side view thereof taken from the right side of FIG. 4.
Figure 10:
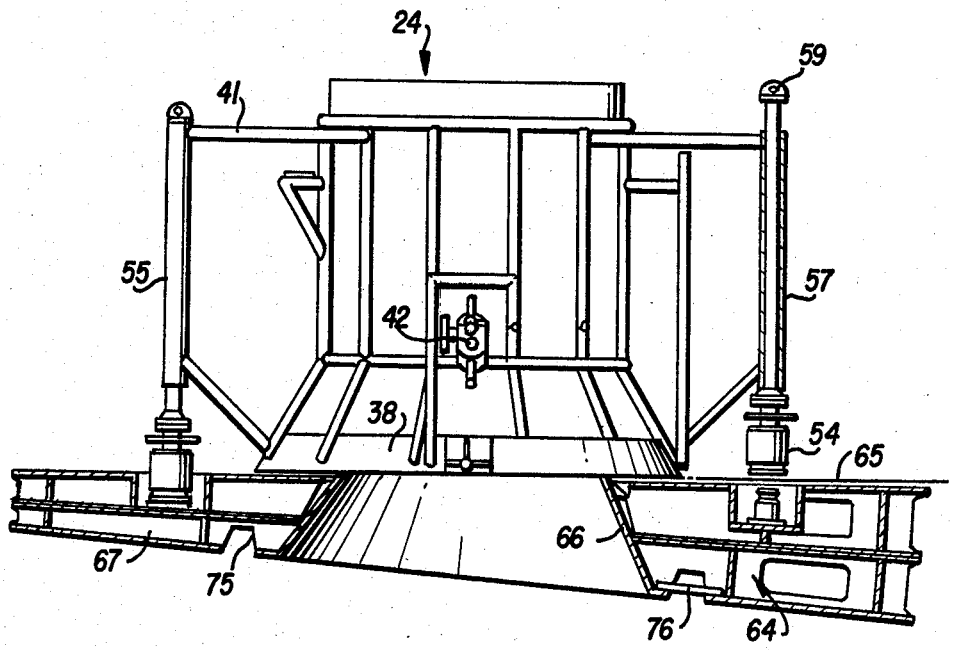
FIG. 10 is a side view showing the tool of the present invention connected to a leveling wafer.

As best seen in FIGS. 4, 5 and 6, the present tool is of generally circular configuration, having a circular central hollow portion with an inside diameter to fit over the 6′ diameter monopile. At the lower part of the central portion is fixed lower cone 38 as previously described. Above lower cone 38 is upper cone 39 which is removable secured by mounting brackets 45 and has a diameter of about 6′1″ at its top and about 7′ at its bottom. The central portion of the tool frame is made up of 14 vertical braces 40, which define a circular center of about 7′ inner diameter, having an upper circular brace 60 and a lower circular brace 61 secured to each other by the vertical braces 40. These braces 40, 60 and 61 are all securely fastened together, preferably by welding. A pair of guide sleeves 55 and 57, each about 8′ long, are mounted by a plurality of diagonal braces 41 at two points on diametrically opposite sides of the tool, each being spaced radially outwardly of the center at a distance greater than any other part of the tool so as to furnish lift points about 14′ apart. Lift pipes 56 and 58 are telescopically mounted within guide sleeves 55 and 57, respectively, each having a lifting point 59 at its upper end and hydraulic connectors 52 and 54, respectively, at their lower ends. These connectors are hydraulically activated from the surface to open or close, so as to lock onto a lift pin 72 recessed into the surface of a leveling wafer, which will be later described. For the sake of illustration, lift pipe 56 and its connector 52 are shown in a lower position than pipe 56 and connector 54 in FIG. 4. In actual practice, these connectors 52 and 54 would usually be at the same height since they would be unlocked from pins 72 at the same time and elevated by an upward force on lifting points 59. FIG. 10 shows the tool connected to the leveling wafer.

Spaced 90° from the guide sleeves 55 and 57 are mountings for TV cameras 42 and 43, as will be described later in greater detail. Within the "V"-shaped portion defined by diagonal braces 41, which support guide sleeve 55, is a mounting for inclinometer 44.

The pile attitude is measured with three instruments. The primary measurement device is a gyroscopic survey tool. This instrument can provide all three pieces of information needed. A second generation gyrocompass, the tool scans components of the earth's spin and gravity vectors to eliminate drift problems. For each survey, the sensors gather data in a series of sequential measurements, and an electronics package reads the data and sends it to the surface via a single conductor. The surface computer calculates azimuth, inclination and toolface direction. In this application, the toolface will be made coincident with an orientation pin 46. With the gyroscopic tool mounted in the survey tool and carefully aligned to read according to the attitude of the plane of the survey tool lower cone 38, the gyroscopic tool can read the departure from horizontal of the ring girder 22 (inclination) and the direction it is leaning (azimuth). The toolface reading will correspond to the direction of the orientation plate 48 on the ring girder, which has an upwardly facing "V"-shaped notch to receive a pin 46 carried by tool 24.

A backup to the gyroscopic tool's measurement of inclination is a two-axis inclinometer 44. This instrument measures departure from vertical in two orthogonal planes. The information will be used to calculate the amount of ring girder slope and the relative direction of the slope.

Figure 3:
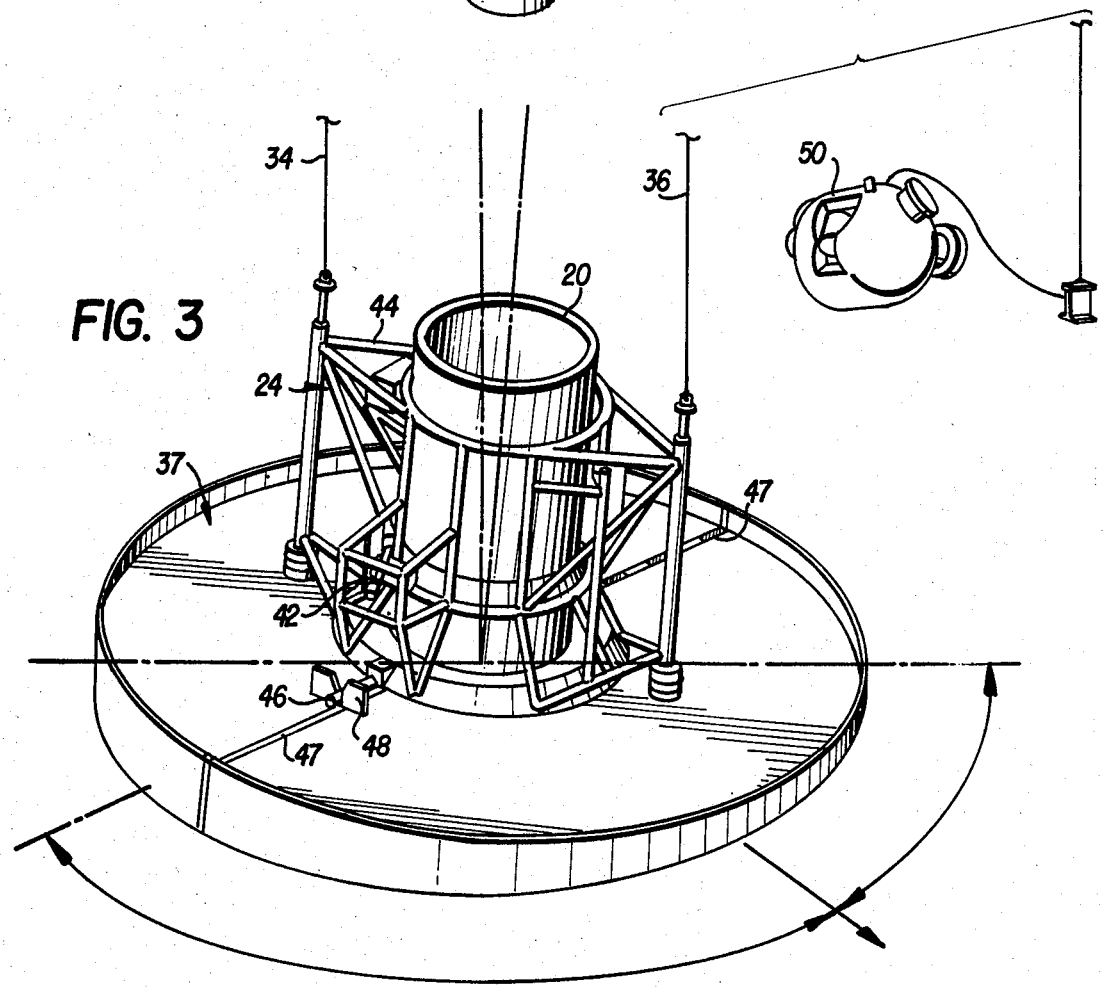
FIG. 3 is a perspective view of the tool of this invention landed on top of the ring girder with a mobile TV camera viewing it.

Redundancy of measurement of the bearing of the orientation plate is provided by an RCV 50 (see FIG. 3) with its gyrocompass. The RCV can be maneuvered to be in line with a painted stripe 47 on the ring plate 37 and a measurement made of the bearing of the plate.

A rough visual confirmation of survey tool attitude is provided by a slope indicator 68 mounted beneath a TV camera 43. This slope indicator can also measure ring girder slope and direction.

The instruments are mounted on the survey tool 24 during construction. At that time, they can be accurately surveyed to calibrate their readings with respect to the survey tool. Mountings are then fixed and the instruments removed while the tool is transported.

Figure 9:
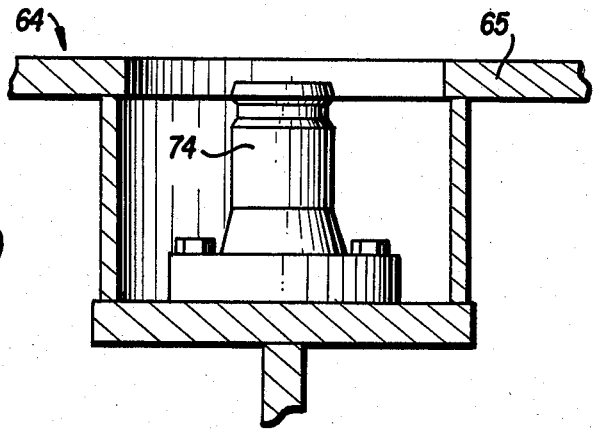
FIG. 9 is a side view of a connector pin used for attaching the tool to the wafer.

We now turn to the second intended use of the present tool, as a running tool for the transport of the leveling wafer 64 to the site of the monopile-platform. During this use, as shown in FIG. 10, the upper cone 39 is preferably removed from the tool. The leveling wafer 64 to be transported would weigh at least 50,000 pounds and is difficult to handle, especially when it is being hoisted off the deck of a ship or drilling platform. The tool of this invention greatly facilitates that hoisting and handling. After the tool, then carrying the wafer 64, is suspended in the air by cables 34 and 36, it is preferable to have at least two additional cables, such as 28 and 30 of FIG. 1, secured to the hoisting bar 32 so that the rotation of the tool (and wafer) in relation to the monopile-platform can be controlled by reeling in of one cable and slacking off on the other cable. The hoisting bar is non-rotatably secured to the tool 24 to accomplish this movement by cables 28 and 30. It is, of course, necessary to detachably secure the leveling wafer 64 to the tool, as shown in FIG. 10, and this is accomplished by providing two remotely controlled hydraulic connectors 52 and 54 and removing upper cone 39, as in FIG. 10. The hydraulic connectors are mounted on lift pipes 56 and 58, which slide within guide sleeves 55 and 57 so that they do not interfere with the tool when it is being used to survey the pile or set down on deck. When the tool is set down on the leveling wafer, the connectors reach down to, and clamp onto, a pair of recessed lift pins 72 (see FIGS. 9 and 10) on the wafer. When the assembly is lifted, the weight of the wafer is lifted vertically through the connectors 52, 54, the lift pipes 56, 58, the lifting points 59 and the lifting slings 32, bypassing the survey tool. The tool thus does not need to carry the wafer weight, thereby requiring only a lightweight construction. The wafer has its own inner centering cone 66 and thus upper cone 39 is unnecessary during this phase and is removed during installation of the wafer 64.

The 4000 pound survey tool is actually picked up by the wafer, and the cone 66 on the wafer takes the attitude of the top of the wafer. Because the survey tool upper cone 39 has been removed, it permits the pile to pass readily through the combined wafer and survey tool without affecting the tool. Once the wafer is installed, the instruments on the survey tool are used to check the wafer. A reading can also be taken which will confirm the azimuth of the orientation slot in the wafer. This saves a trip to check the foundation wafer.

The TV cameras 42 and 43 on the survey tool perform several functions. Both cameras are used during landing of the tool to locate the top of the pile. Once over the pile, one camera 42 watches the orientation pin 46 to ensure that it mates up properly with the ring girder orientation plate 48. After landing, the other camera 43 checks the slope indicator 68 over which it is mounted. When the tool is used to run the wafer, both cameras view the slope indicators 74 mounted in the wafer. These indicators are preferably in the form of partially spherical spirit or bubble levels.

Figure 7:
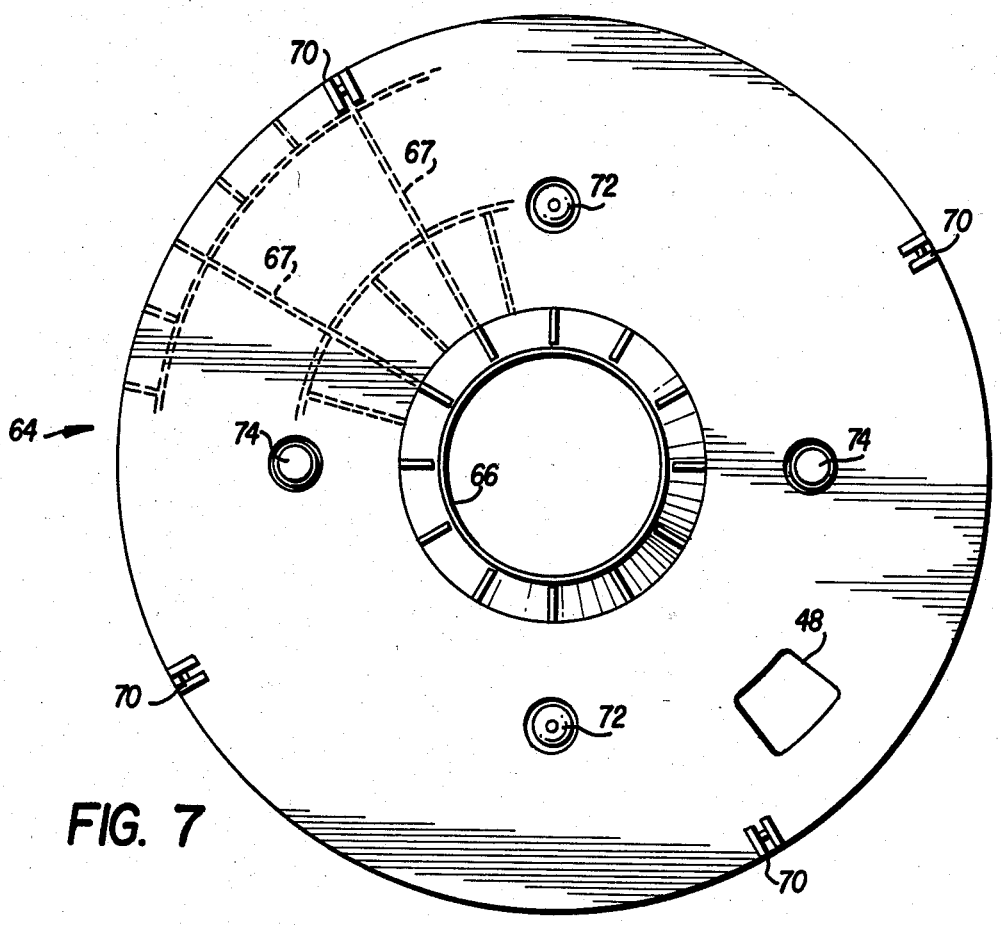
FIG. 7 is a top view of the wafer which is transported by the present tool.
Figure 8:
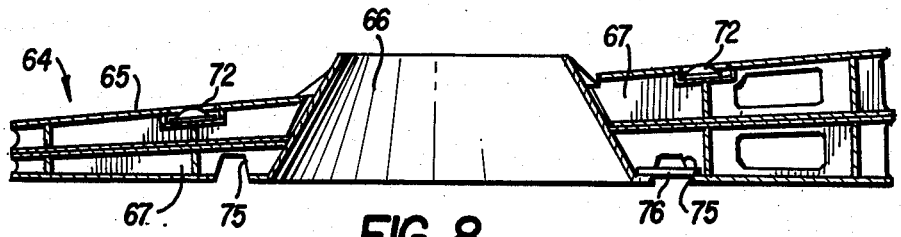
FIG. 8 is a side view of the wafer of FIG. 7.

The azimuth of the leveling wafer on the ring girder is controlled by the orientation plate 48, previously used in connection with controlling the azimuth of the tool 24 and its orientation pin 46. The underside of the leveling wafer 64 (see FIG. 7) has an annular groove 75, which is spaced from the center of the wafer by the same distance as the spacing of the orientation plate 48 from the center of the ring girder. Thus, when the wafer is lowered over the ring girder, the orientation plate will project into annular groove 75. A wafer orientation pin 76 is welded across groove 75 at a predetermined circumferential position so that when pin 76 is in the "V" groove of plate 48, the azimuth is correct. The cables 28 and 30 are used to rotate the wafer into the correct azimuth position.

After the wafer is ascertained to be in the correct position, the remote controlled hydraulic connectors 52 and 54 are opened and the tool 24 is hoisted back up to the surface by cables 34 and 36. Lifting on lift points 59 by these cables causes lift pipes 56 and 58 to slide within guide sleeves 55 and 57, thus lifting connectors 52 and 54 off lift pins 72. The wafer then remains on the ring girder, without any fastening being necessary and the tool 24 may be used again at another site. A suitable template is then lowered over the level upper surface of the wafer oriented and locked to the monopile and the desired equipment is installed on the template.

We claim:

1. A foundation level and orientation tool for providing a level surface for undersea oil well equipment comprising:

a hollow central portion having an inner dimension to fit over a monopile support structure projecting from the seabed floor, said monopile support structure having an inclined platform around it;

a reinforcement frame carried by said central portion and having a plurality of interconnected braces secured to the central portion to form a tool framework structure of high inherent strength, said structure having downwardly projecting means for contacting the upper surface of said platform;

means on said tool to carry instrumentation to measure the inclination of said platform;

attachment means on said tool for engagement with an inclination correcting wafer to transport said wafer to the site of said undersea equipment for placement upon and leveling of said platform.

2. The tool of claim 1, in which said frame has mounting means for at least one TV camera positioned to assist in guiding the tool into underwater working position.

3. The tool of claim 1, including means for mounting instruments to calculate the position of the tool in relation to said member projecting from the seabed floor.

4. The tool of claim 1, including a central cone-shaped portion on the underside thereof for landing the tool over a monopile projecting from the seabed floor.

5. The tool of claim 1, in which the means for contacting the upper surface of said platform is a cone-shaped ring centrally located on the bottom of said tool.

6. The tool of claim 1, in which the attachment means is at least one hydraulic locking cylinder carried by a generally vertically movable support, said cylinder having means to engage with an upwardly facing lift pin on said wafer.

7. The tool of claim 1, including an upwardly projecting orientation slot on said platform and an alignment pin on said tool to engage said slot for positioning the tool in relation to the platform.

8. The tool of claim 1, including instrumentation to measure the amount said platform departs from the horizontal, the azimuth of the direction of departure, the direction of said departure in relation to the center of said platform.

9. The tool of claim 8, in which the instrumentation is a gyroscopic survey tool and means for transmitting to the surface the underwater data derived thereby.

10. The tool of claim 8, in which the instrumentation includes a two-axis inclinometer to measure the departure from the vertical in two orthogonal planes.

11. The tool of claim 1, including a remote control TV camera with means to move it away from tool to view the landing of the tool on the member projecting from the seabed floor.

12. The tool of claim 11, including a visual stripe on said platform for viewing by said remote control TV camera.

13. The tool of claim 1, including a remote control TV camera mounted on the tool and positioned to view a visual reading instrument carried by the tool.

14. The tool of claim 13, in combination with a level correcting wafer carried by said attachment means, said wafer having visual slope indication means positioned to be viewed by the TV camera mounted on the tool.

15. The tool of claim 13, in which the visual reading instruments includes a slope indicator.

16. The tool of claim 15, in which the slope indicator is a spirit level.

17. The tool of claim 1, including a detachable mounted frusto-conical upper ring positioned around said hollow central portion to aid in landing and centering the tool over a monopile projecting from the seabed floor, a lower adaptor ring having a lower surface for engagement with the upper surface of said platform to locate the tool in relation to the platform so that the instruments carried by the tool can then determine the inclination of the platform.

18. A foundation level and orientation tool for undersea oil well equipment, comprising:

a generally circular body of interconnected braces defining a hollow central portion having an inner diameter to fit over a monopile projecting from the seabed floor, said monopile having an inclined ring girder around it;

a frusto-conical upper ring detachably secured around said hollow central portion for guiding the landing of the tool over said monopile;

a frusto-concial lower ring secured to the lower end of said tool;

the lower edge of said lower ring being a surface for contacting said ring girder;

means on said body to carry instrumentation to measure the inclination of said ring girder;

means for mounting at least one remote control TV camera on said body for viewing the orientation of said tool in relation to said ring girder;

attachment means on said tool for carrying an inclination correcting wafer for placement over the ring girder, said attachment means comprising at least two remotely controlled hydraulic locking cylinders having means for engaging said wafer, said cylinder being mounted on said body for general vertical movement from an upper position above the level of the lower edge of said lower ring to a lower position for engagement with said wafer.

19. A method for leveling the upper surface of a ring girder attached to a monopile projecting from the seabed floor, said method comprising:

placing an annular framework carrying inclination measuring instrumentation around said monopile to contact the surface of said ring girder and ascertaining the inclination and azimuth of inclination of said ring girder;

fabricating an inclination correcting wafer for placement over said ring girder;

supporting said wafer detachably underneath said annular framework; and lowering said wafer over said monopile while placing it at the previously determined azimuth so that said wafer, when in place, provides a level surface above said ring girder.

20. The method of claim 19, including the steps of contacting the surface of said ring girder by means of a lower ring on the lower part of said framework;

removing an upper detachable ring from said framework after ascertaining the inclination of said ring girder; and then supporting the wafer from said framework and lowering the wafer over the monopile.

* * * * *